United States Patent [19]

Krueger, Sr.

[11] Patent Number: 4,649,583

[45] Date of Patent: Mar. 17, 1987

[54] THERAPEUTIC SUPPORT DEVICE

[76] Inventor: Donald P. Krueger, Sr., 3412 Park Dr., Parma, Ohio 44134

[21] Appl. No.: 783,527

[22] Filed: Oct. 3, 1985

Related U.S. Application Data

[63] Continuation-in-part of Ser. No. 671,228, Nov. 14, 1984, abandoned.

[51] Int. Cl.[4] ..... A47C 21/06; A47C 31/00

[52] U.S. Cl. ..... 5/508; 5/446

[58] Field of Search ..... 5/446, 447, 464, 448, 5/437, 462, 440, 508

[56] References Cited

U.S. PATENT DOCUMENTS

| | | | |
|---|---|---|---|
| 2,699,558 | 1/1955 | Hapman | 5/446 |
| 2,885,695 | 5/1959 | Ferzel et al. | 5/446 |
| 3,125,768 | 3/1964 | Rickert | 5/446 |
| 3,245,092 | 4/1966 | Kreuz | 5/446 |
| 3,489,142 | 1/1970 | Golay | 5/446 |
| 4,476,594 | 10/1984 | McLeod | 5/464 |

*Primary Examiner*—Alexander Grosz

*Attorney, Agent, or Firm*—Donald A. Bergquist

[57] ABSTRACT

The present invention relates to the technical field of therapeutic support devices, and more particularly relates to a novel foldable and portable support device for use in therapeutic applications, such as in providing support to the user's lumbar and other related parts of the human torso. The support device of the invention finds particular application as an underlayment for conventional type of commercial and/or domestic sleeping mattresses and it features a new and novel hinge arrangement to maintain the device, and hence the mattress, in a flat condition while in use.

6 Claims, 6 Drawing Figures

THERAPEUTIC SUPPORT DEVICE

This application is a continuation in part of Ser. No. 671,228, filed Nov. 14, 1984, now abandoned.

TECHNICAL FIELD

The present invention relates to the technical field of therapeutic support devices, and more particularly relates to a novel foldable and portable support device for use in therapeutic applications, such as in providing support to the user's lumbar and other related parts of the human torso. The support device of the invention finds particular application as an underlayment for conventional type of commercial and/or domestic sleeping mattresses and it features a new and novel hinge arrangement to maintain the device, and hence the mattress, in a flat condition while in use.

BACKGROUND OF THE INVENTION

Heretofore, it has been long recognized that there has been and continues to exist a severe problem with proper therapeutic support for the lumbar regions of the back particularly with older persons. It will be recognized that this problem often times develops with a mattress or other sleeping support that is deficient for any number of reasons. For example, the mattress could be defectively designed or simply improperly selected by reason of the user's own erroneous choice resulting in a mattress that is not properly contoured or which is too soft to provide the necessary therapeutic support for the user's body during rest or sleep, especially as it may affect the lumbar region of the back. It can be appreciated that persons doing considerable traveling and who may already have potentially serious back problems are often times confronted with sleeping accommodations that are totally inadequate with respect to the availability of a bed having a mattress of the type which would render any therapeutic benefit. More often than not, it is not surprising to find a sleeping accommodation wherein the bed's mattress including its springs are so old and worn so as to simply not provide the necessary therapeutic back support for the user. Indeed, this problem can be keenly appreciated by those persons having lower back problems. Unfortunately, for one reason or another this problem has been and presently is one of a serious nature and is sought to be alleviated, at least in part, by the strong trend of the populus to control weight through proper diet and exercise. In the meantime, however, there are many persons, particularly those of a senior age, whom are afflicted with chronic lower back problems for various resons as aforesaid. Accordingly, it is to these persons and for these reasons that the present invention seeks to provide that which the applicant believes to be a long-felt need.

DISCLOSURE OF THE INVENTION

In the present invention, there is provided a new and novel therapeutic support device in the form of a portable and foldable support insert of a two-piece construction which is intermediately hinged for foldability in a book-like fashion for compact storage during non-use thereof. More specifically, the therapeutic support device includes a support insert comprising two generally symetrically shaped polygonal, such as rectangular, plate sections which are pivotally hinged together on their corresponding adjacent and confronting ends for relative pivotal movement toward one another into a stored position from an open usable condition. The present invention includes a new and novel hinge construction which supports the mating plate sections in a predetermined upwardly arched position so as to define a generally apex angle disposed above the general horizontal plane of the support insert. By this construction and arrangement, the downward forces applied in one direction causes the hinge connection between the plate sections to yield elastically downwardly into a generally planar condition so as to maintain the support insert, and hence the mattress, in a generally flat or a level condition, thereby to provide maximum therapeutic support for the user. A carrying handle strap-like means is provided for readily transporting the support insert, and a flexible latch means are provided for detachably locking the respective plate sections in a closed, generally parallel, condition for transport or storage.

Accordingly, the therapeutic support device of the present invention provides a portable and foldable structure which is of a relatively simple yet durable construction for use by persons of all ages to alleviate problems for persons having lower back difficulties. The support device of the invention is readily transportable and can quickly and easily be installed for ready use thereof.

Other advantages and objects relating to the design and function of the therapeutic device of the invention will become more apparent as the following description proceeds when taken in conjunction with the drawings included herewith.

BEST MODE FOR CARRYING OUT THE INVENTION

Figure 1:
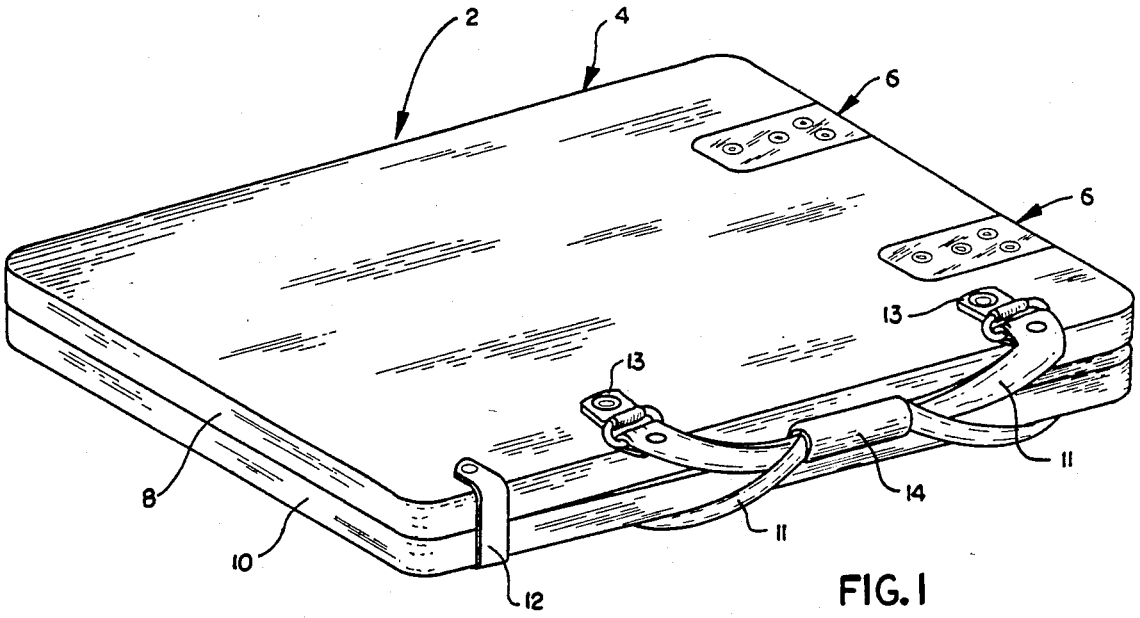
FIG. 1 is a generally perspective view illustrating the therapeutic support device of the present invention in the closed condition for ready transport or storage.

Referring again to the drawings and in particular to FIG. 1 thereof, there is illustrated the therapeutic device of the present invention, designated generally at 2, in the folded condition for ready portability or storage. In the form illustrated, the support device includes a two-piece body joined together in pivotal relation by a pair of hinge members located generally at 6. The body 4 includes a pair of oppositely disposed plate sections 8 and 10 which are hinged together for pivotal movement toward and away from one another in a book-like fashion from a closed position to an open position for use. The plate sections 8 and 10 are of a flat construction and are of a polygonal configuration preferably being of rectangular shape in top plan view, such that the overall structure is of a generally rectangular configuration having the longitudinal dimension extending at right angles to the pivotal axis defined by the hinge connections located generally at 6. Accordingly, the hinge connections at 6 provide a horizontal pivotal axis disposed at right angles to the longitudinal central axis of the support device in the open condition thereof.

The plate sections 8 and 10 may be held in the closed condition for ready portability or storage by means of a flexible snap strap 12. Although only one such strap is illustrated, it is to be understood that any number and/or arrangement of the straps may be utilized, as desired. Also, the support device is provided with a carrying handle which is fixedly attached, as at 13 to the respective plate sections 8 and 10. The handle portion 14 may be made of any suitable material and it detachably encloses a pair of straps 11 which are permanently secured, as at 13, in laterally spaced relation to the plate sections 8 and 10 so as to provide maximum support and stability therefor.

Figure 2:
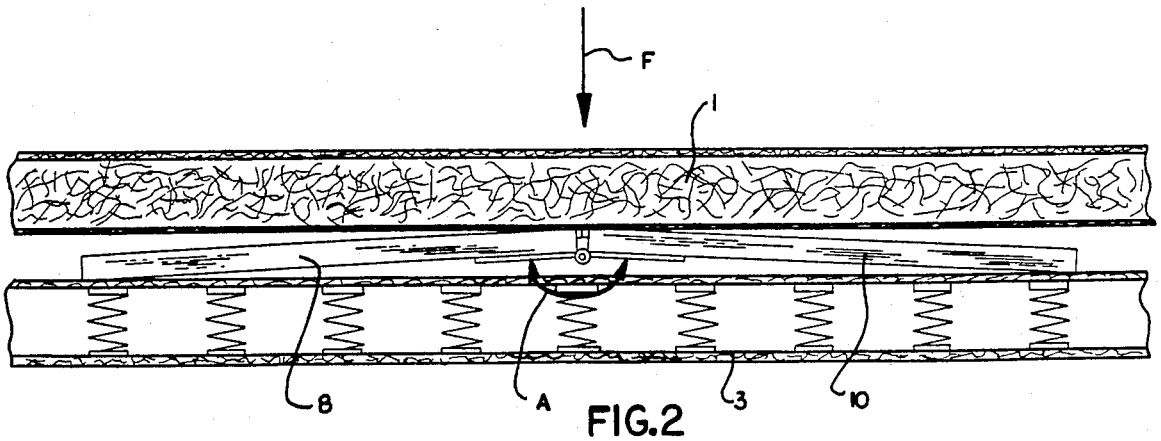
FIG. 2 is a fragmentary, front elevation view on a slightly enlarged scale illustrating, using an exaggerated apex angle, the upwardly arched angular condition of the plate sections defining the therapeutic support device in accordance with the invention.

As best illustrated in FIG. 2, in the installed condition the therapeutic support device may be inserted between, for example, a mattress, as at 1, and a support member 3, such as bed springs or the like. In such condition, the support device is disposed such that the plate sections 8 and 10 are oriented in an upwardly arched condition defining an apex angle disposed above the general plane of the support member 3. This apex angle defines an obtuse angle A of preferably between 174° and 178°, but in any case, at least 170° but less than 180°. By this construction and arrangement, the plate members 8 and 10 are, in effect, pre-loaded relative to the hinge connections generally at 6 so that when a downward force, as illustrated by the arrow F, is applied to the mattress 1 the hinge connections at 6 yield within the elastic region of their stress-strain curve so as to allow the plate sections 8 and 10 to assume a generally horizontal or planar condition thereby to support the mattress in a like manner. It has been found, for example, that if this pre-loading is not provided then the plate members would be downwardly arched in the opposite direction by the applied force thereby not maintaining the mattress in the desird horizontal or planar conditions during use thereof.

Figure 3:
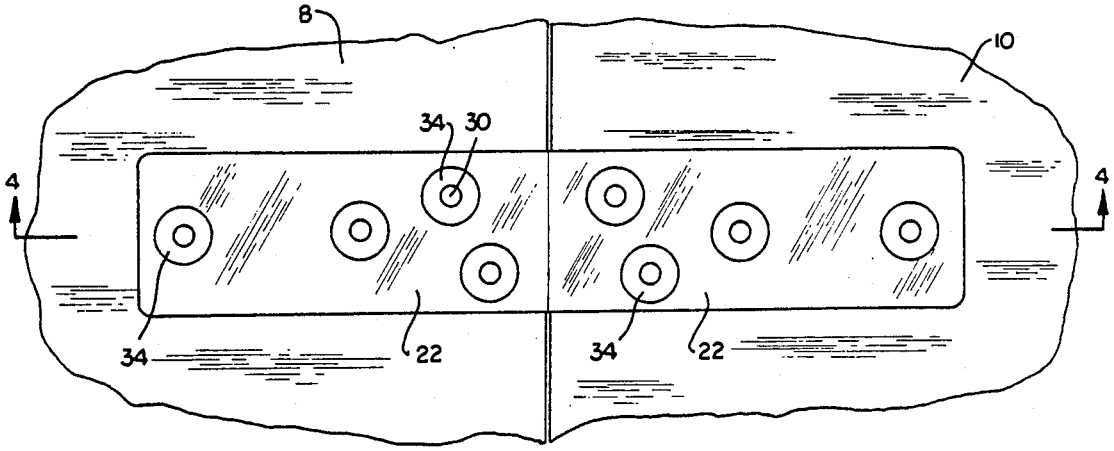
FIG. 3 is a fragmentary, top plan view looking down on the hinge construction of the present invention.
Figure 4:
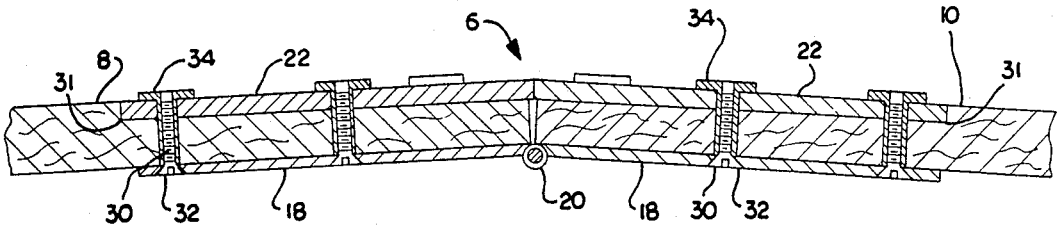
FIG. 4 is a fragmentary, horizontal section view of the hinge construction taken along the line 4—4 of FIG. 3 with the support device in the open position, but with no load applied.
Figure 5:
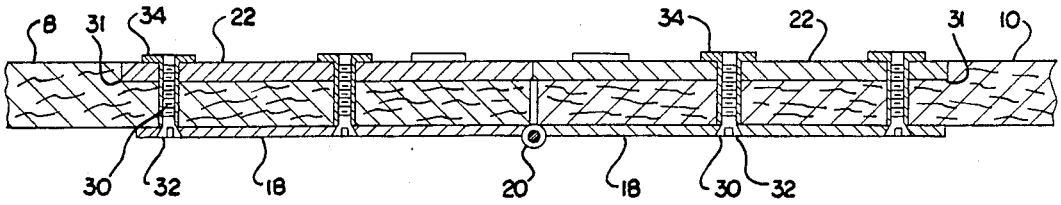
FIG. 5 is a fragmentary, horizontal section view corresponding to that of FIG. 4 but with the support device under load.

In reference to FIGS. 3, 4, and 5, the hinge connections at 6 for pivotally joining together the plate sections 8 and 10 are of identical construction each including hinge plates 18 which are pivotally connected together by hinge pins 20, as known in the art. The hinge plates 18 are provided with a plurality of apertures to receive threaded fasteners 30 which extend through backing plate members 22 secured in recessed relationship on the opposite side of the respective plate sections 8 and 10. As seen, the plate sections are recessed, as at 31, to accommodate backing plates 22 such that the backing plates lie flush with the outer surface of the plate sections. The fasteners include screw heads 32 which are counter-sunk and lie flush with the hinge plates 18 with the screws 30 being threadably received into "T"-shaped cap heads 34 which lie flat against the confronting upper surfaces of the respective backing plates 22.

Figure 6:
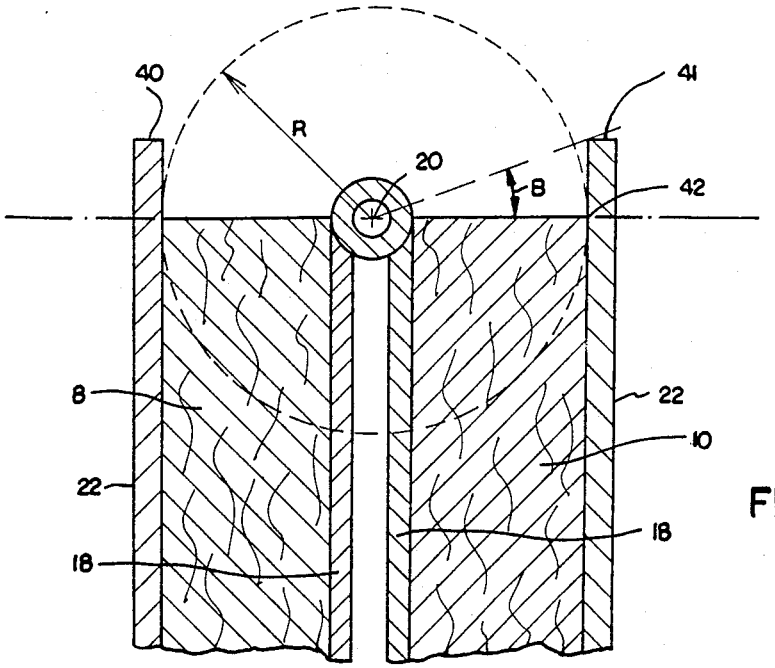

FIGS. 4 and 5 most clearly show the special hinge construction that provides the upwardly arched condition of the opened, but not loaded, support device of the invention. This condition is achieved by mounting the hinge members 18 and backing plate members 22 as shown in FIG. 4 in such manner that the backing plate members make contact before the hinge members open to an angle A of 180°. One way to ascertain that this condition will be achieved is to fold the therapeutic support device to a nearly-closed position, as shown in FIG. 6, one in which the plates 8 and 10 are exactly parallel to one another; when the plates are in this position it will be seen that the surfaces of the backing plates that will ultimately make contact when the support device is in its open position are not simultaneously coplanar with the pivotal axis of the hinges, i.e. the central axis of the hinge pin 20. The backing plate extends beyond the line of tangency 42 between the backing plate and an imaginary circular cylinder whose intercept with the plane of the drawing is indicated by a circle of radius R, which cylinder is centered upon the pivotal axis of the hinge 20, which line of tangency is perpendicular to the paper of the drawing and is thus visible as only a point indicated at 42. This extension beyond said line of tangency subtends a central angle B, one leg of which is a radius of the cylinder that passes through said line of tangency and the apex of which is at the pivot axis, here shown greatly exaggerated, of greater than 0° but not more than 5°; preferably this central angle is between 1° and 3°. This does not imply that each of the said mating surfaces cannot be independently coplanar with the pivotal axis of the hinges, as in one design such independent coplanarity would exist with the obtuse angle between the two planes being equal to the aforesaid angle of at least 170° but less than 180°; in this case, sumultaneous coplanarity will exist when the mating surfaces meet in abutment when the support device is in its open position for use as shown in FIG. 4.

Upon applying the load as indicated by the arrow F in FIG. 5, the support device tends to a flattened condition by principally the elastic deformation of the hinge elements, especially those commonly referred to as hinge knuckles which surround the hinge pin 20. One must appreciate that with the device of this invention in practical use, the downward force represented by the arrow F is not balanced solely by the forces within the hinge joint construction as shown, but as the support device is flattened from its arched position it receives more and more support from the underlying springs. The present invention serves to distribute these supporting forces over a larger area of the underlying springs.

It will be understood that other advantages and objects of the present invention are contemplated by the annexed claims hereof.

I claim:

1. In a therapeutic support device of a foldable and portable construction comprising a pair of oppositely disposed generally flat plate sections of essentially uniform thickness, the plate sections being of generally symmetrical polygonal configuration in top plan view and being pivotally connected together on adjacent and confronting edges for pivotal movement toward one another into a closed position and away from one another into an open position for use thereof, the improvement which comprises that said pivotal connection includes at least one hinge means including a pair of hinge plates pivotally connected together by a hinge pin, said hinge plates being secured through the thickness of the plate sections to backing plates secured on the opposite side of the respective plate sections wherein in the unloaded condition at least one of said backing plates extends in a direction away from the securing means of said backing plate beyond the line of tangency of a surface of the backing plate and an imaginary circular cylinder centered upon the pivotal axis of the hinge.

2. A therapeutic support device in accordance with claim 1 wherein said extension beyond the line of tangency subtends a central angle at the pivotal axis that is greater than 0° but not greater than 5°.

3. A therapeutic support device in accordance with claim 1 wherein said extension beyond the line of tangency subtends a central angle at the pivotal axis that is between 1° and 3°.

4. A therapeutic support device of a foldable and portable construction comprising a pair of oppositely disposed generally flat plate sections of essentially uniform thickness, the plate sections being of generally symmetrical polygonal configuration in top plan view and being pivotally connected together on adjacent and confronting edges for pivotal movement toward one another into a closed position and away from one another into an open position for use thereof, wherein said pivotal connection between said plate sections includes at least one hinge assembly including a pair of oppositely disposed hinge plates pivotally connected together by a hinge pin, said hinge plates being fixedly secured to said plate sections, the improvement which comprises said hinge pin being disposed such that the confronting ends of said plate sections are upwardly arched by an obtuse angle in the unloaded condition whereby said plate sections are moved into a substantially common horizontal plane on application of load forces on said pivot connection that cause elastic deformation of said hinge elements resulting in said movement.

5. A therapeutic support device in accordance with claim 4 wherein said obtuse angle is smaller than 180° and greater than or equal to 170°.

6. A therapeutic support device in accordance with claim 4 wherein said obtuse angle is between 174° and 178°.

* * * * *